United States Patent [19]

Suh et al.

[11] Patent Number: 4,576,520

[45] Date of Patent: Mar. 18, 1986

[54] MOTION DAMPING APPARATUS

[75] Inventors: Sung L. Suh, Orinda; Gerald E. Burns, Walnut Creek; William H. Silcox, San Francisco, all of Calif.

[73] Assignee: Chevron Research Company, San Francisco, Calif.

[21] Appl. No.: 659,601

[22] Filed: Oct. 11, 1984

Related U.S. Application Data

[63] Continuation-in-part of Ser. No. 464,247, Feb. 7, 1983, abandoned.

[51] Int. Cl.[4] ..... E02B 17/00

[52] U.S. Cl. ..... 405/224; 405/195; 405/205; 114/265

[58] Field of Search ..... 405/224, 195, 203–209; 175/5–7, 27; 114/264, 265; 166/355

[56] References Cited

U.S. PATENT DOCUMENTS

| | | | |
|---|---|---|---|
| 1,670,524 | 5/1928 | Sachs | 114/255 X |
| 2,889,795 | 6/1959 | Parks . | |
| 2,952,234 | 9/1960 | Levinson | 114/13.5 |
| 2,986,889 | 6/1961 | Ludwig | 114/293 X |
| 3,224,401 | 12/1965 | Kobus | 405/205 |
| 3,397,545 | 8/1968 | Leavitt . | |
| 3,407,767 | 10/1968 | McClintock et al. . | |
| 3,566,608 | 3/1971 | Ramme | 114/265 X |
| 3,739,737 | 6/1973 | Baier . | |
| 3,805,725 | 4/1974 | Pease et al. | 114/126 |
| 3,815,536 | 6/1974 | Duc . | |
| 3,916,812 | 11/1975 | Bartels | 114/230 |
| 3,939,991 | 2/1976 | Person . | |
| 3,943,868 | 3/1976 | Person et al. . | |
| 3,986,471 | 10/1976 | Haselton . | |
| 4,121,806 | 10/1978 | Iato et al. | 254/172 |
| 4,226,554 | 10/1980 | Vandiver et al. | 405/195 |
| 4,231,313 | 11/1980 | Heerema et al. | 114/265 |
| 4,364,323 | 12/1982 | Stevenson | 114/265 |
| 4,395,160 | 7/1983 | De Jong | 405/195 |

OTHER PUBLICATIONS

"Mechanical Vibrations", by F. S. Tse, I. E. Morse, and R. T. Hinkle, 1963.

*Primary Examiner*—Dennis L. Taylor
*Attorney, Agent, or Firm*—S. R. LaPaglia; E. J. Keeling; P. L. McGarrigle

[57] ABSTRACT

The present invention generally relates to devices and methods used to suppress the motion of an offshore structure due to wind, wave, seismic, and current forces. More specifically, the invention suppresses structural excitation due to secondary wave forces.

The apparatus comprises a mechanical energy absorbing means and a submerged mass. The mechanical energy absorbing means may be a combination of linear or non-linear springs and dampers and is attached to the structure so the vibrating motion may be transferred to the motion damper. The proper weight or size of the damper and mechanical energy absorbing means is determined by first measuring the natural frequency of the structure and the mass of the structure then using those numbers in an equation to calculate the mass and spring constant for the desired apparatus.

27 Claims, 7 Drawing Figures

MOTION DAMPING APPARATUS

CROSS-REFERENCE TO RELATED APPLICATIONS

This application is a continuation-in-part of application Ser. No. 464,247, filed Feb. 7, 1983, now abandoned, which is incorporated herein in its entirety by reference.

FIELD OF THE INVENTION

The present invention relates to a motion damping apparatus constructed to reduce the motion of an offshore structure. More specifically, the invention relates to a motion damping apparatus designed to reduce structural fatigue due to wind, wave, and current forces.

BACKGROUND OF THE INVENTION

As world oil supplies decrease, it is becoming increasingly desirable for companies to drill for oil at offshore locations. Exploration and production of oil from below the sea floor depend partly upon the stability of the offshore structure and existing designs utilize either a buoyant or bottom supported structures. Currently, one type of offshore oil platform is a Tension Leg Platform (TLP) which consists of a positively buoyant structure tied down by tendons that are under severe tension. TLP structures, like many others, are to be put into use for long periods of time, something on the order of 20 to 30 years or more. As a result, forces that act on these structures, such as wave, current and wind forces, contribute to fatigue and reduce the structure's ultimate life span. This fatigue may, of course, be acute or chronic, but here the discussion is limited to the chronic stress and strain generated over longer periods of time.

Wave action is considered the greatest source of structural fatigue because wave forces will cause the structure to resonate at its natural frequency. Once this happens, the initial wave force is amplified into a larger, more distinctive force which may subject the structure and tendons to higher loads than they could bear.

When a TLP encounters waves, its response may include heave, pitch, roll, yaw, surge, and sway. Heave refers to vertical movement of the buoyant body; pitch refers to rotational movement about the transverse axis; roll is movement about the longitudinal axis; surge and sway refer to horizontal movement; and yaw is rotation about the vertical axis. Of these, the three major responses we are concerned with are heave (see FIG. 4A), pitch (see FIG. 4B), and roll. The wave forces that contribute to the heave and pitch may also be divided up into two components; i.e., a primary and a secondary motion. Primary motion is that which causes the large or initial vertical heave due to the wave trough and crest displacement or to the large initial pitch due to the impact from the front of the wave (or even the structure riding the wave surface). However, secondary motion is caused by wave dynamics and is more subtle.

In wave dynamics, an ocean wave has many frequency components. Motion due to secondary wave dynamics can occur when two waves of different frequencies interact. For example, if one wave has a period of 5.0 seconds and a second wave has a period of 6.0 seconds they will interact at a given time and create two additional waves. An additive type, or beating, wave will be created with a 30-second period (this generally has an effect on surge motion) and a subtractive, or springing, wave will be created with a period of 2.75 seconds (this mostly has an effect on heave and pitch). Once these waves of varying period encounter the structure, they excite it at its natural frequencies. These natural frequencies are dependent on the structure's mass and stiffness, not the wave, and may be measured using an accelerometer.

As stated before, when these secondary wave forces act on a structure they cause, among other things, heave, pitch, and roll. Since heave is vertical movement when the platform's surface remains parallel to the sea floor, the tendons will be compressed or stretched equally. This means that positive effects from damping will be spread over all the TLP tendons. Pitch, however, is different (roll will not be discussed further as it is the same as pitch, but in a different plane.). When a structure rotates above its transverse axis the tendon stretch or compression is the pitch angle times the length from the transverse axis to the leg. As a result, small angles of pitch may be translated into large tendon tension variations with platforms of greater length. When both heave and pitch responses occur together (which is usually the case) the amount of displacement may be shown by FIGS. 4C and 5 and the equation $\Delta H$ total $=\Delta H_H+\Delta H_p$. This is damaging to the anchoring apparatus and exacerbates any faults or inadequacies in the anchoring device employed. Consequently, if these secondary heave and pitch motions are left unchecked for a long period of time, chronic fatique on the offshore structure will occur.

There are some U.S. patents that deal with absorbing systems for offshore structures; however, they are either connecting devices that try to reduce a load transfer or are directed towards the primary response only and do not reduce high frequency resonant motion. They try to compensate for the larger, first order wave forces in heave, pitch, roll, or surge. Many of these designs are unnecessarily complex and expensive and do not address themselves to the resonant motion at high frequencies. As a result, the focus of the present invention is on absorbing the resonant heave and pitch responses due to secondary wave excitation and the elimination of amplification by the total acceptance of the force load by transferring it to a secondary device. It is the ever present random seastate that is important because pairs or waves are continuously combining to produce secondary forces at the natural frequencies of heave, pitch, and roll.

Consequently, it is the principal object of this invention to provide an economical and simple damping system that will absorb the secondary heave and pitch motion in an offshore structure due to wave exitation (the term "damping" as applied to Applicant's invention means a device that may accept a load from an excited body). It is another object of this invention to reduce chronic fatique on an offshore structure and thus increase its life span.

SUMMARY OF THE INVENTION

Broadly speaking, the present invention provides a method and apparatus for minimizing the high frequency resonant motion of an offshore structure anchored to the sea floor. This damping reduces stress and fatigue imposed upon the structure and anchoring apparatus thereby extending its useful life. The proposed system generally comprises a mechanical energy absorbing device, including a spring and/or damper, in fixed communication with the buoyant structure and a submerged mass. The submerged mass may be a displacing means which comprises a planar body of large surface area or simply a large weight (the planar body is used to displace water to create a hydrodynamic mass and the drag force required to damp the buoyant offshore structure). The displacing means may have buoying means to counterbalance any added weight imposed upon the structure. Elements may also be incorporated to protect the absorbing devices from corrosion and to facilitate their replacement.

The appropriate amount of hydrodynamic added mass and damping depends on the structure. If the response period and mass of the structure are known, the spring and mass of the submerged weight may be approximately calculated using the equation $\omega_n=\sqrt{[K/(M+m)]}$ *where* $\omega_n$ is the response freequency, K is the spring constant, M is the object's mass, and m is the hydrodynamic added mass. Knowledge of these variables will allow proper "tuning" of the total damping apparatus to substantially eliminate motion due to secondary wave forces. Attenuation of the structure's motion is accomplished when the mass of the apparatus vibrates so as to counter the high frequency wave forces.

DETAILED DESCRIPTION OF THE INVENTION

Figure 1:
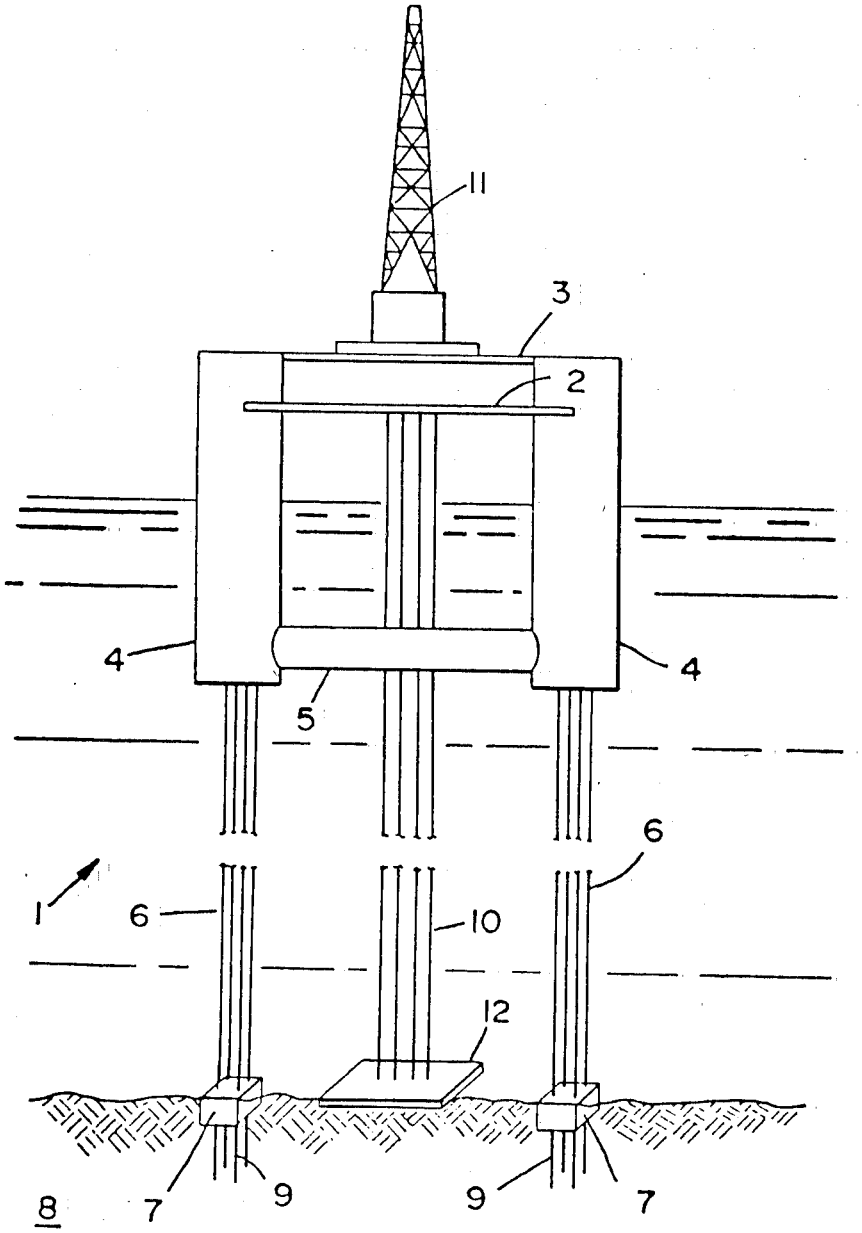
FIG. 1 is an elevation view of a tension leg platform.

FIG. 1 shows an elevation view of a Tension Leg Platform (TLP) 1 deployed at a drilling site. A lower platform 2 is provided on which may be mounted crew living quarters, well test equipment and processing equipment. An upper platform 3 is provided on which may be mounted a pilot house, cranes, the drilling derrick 11, skid base, the drilling string, and a helicopter landing site. Similar conveniences as are known to those skilled in the art of oil exploration and production may also be stored on the lower 2 and the upper platforms 3.

Platforms 2 and 3 are supported by a plurality of annular support columns 4. When the TLP 1 is in its illustrated semi-submersible condition, columns 4 extend beneath the surface of the water where they are connected to pontoons 5. A plurality of tendons 6 extend from each support column 4 to a foundation template 7 secured to the sea floor 8 with anchoring means 9, thereby restricting movement of the structure. A drill string which is housed within the risers 10 extends from platform 2 or 3 between pontoons 5 to the sea floor 8 during drilling and producing operations. Well template 12 maintains the risers 10 in a stationary position relative to the sea floor 8.

Figure 4A:
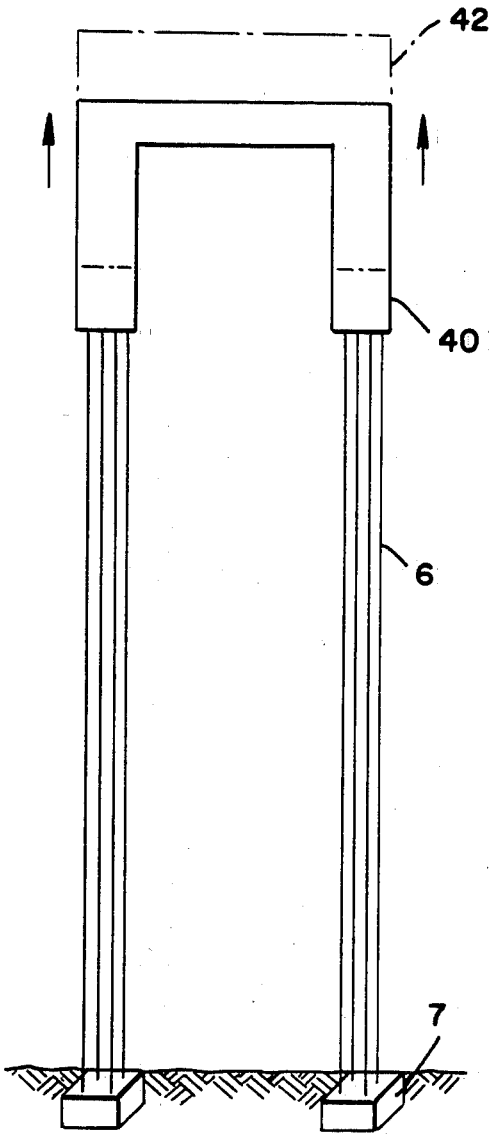
FIG. 4A is an illustration of heave motion on a TLP.
Figure 4B:
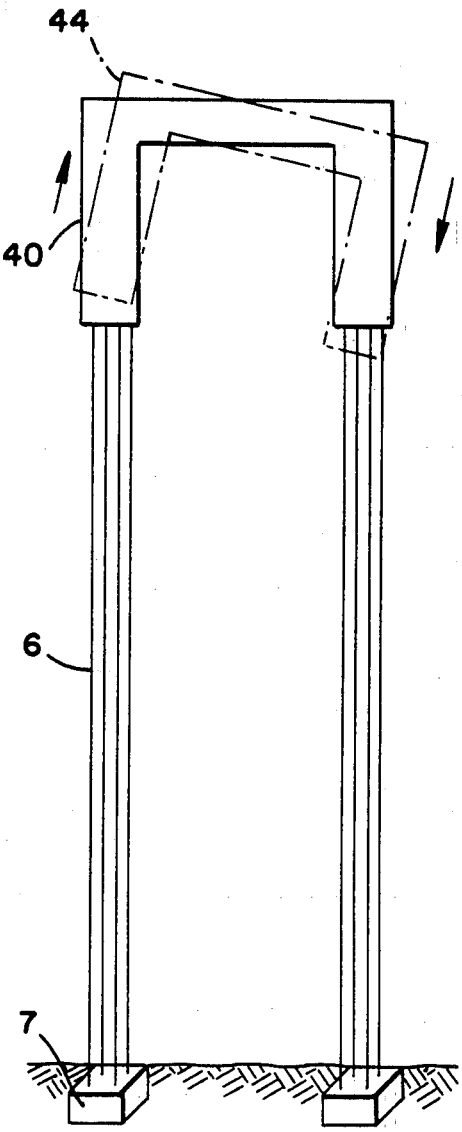
FIG. 4B is an illustration of pitch on a TLP.
Figure 4C:
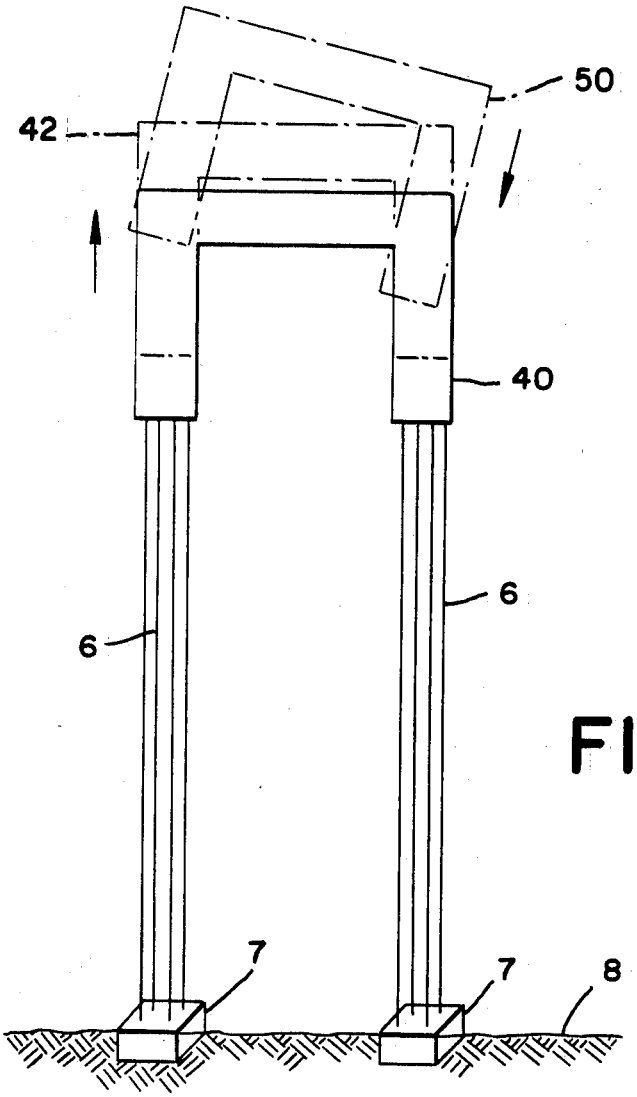
FIG. 4C is an illustration of both heave and pitch motions on a TLP.
Figure 5:
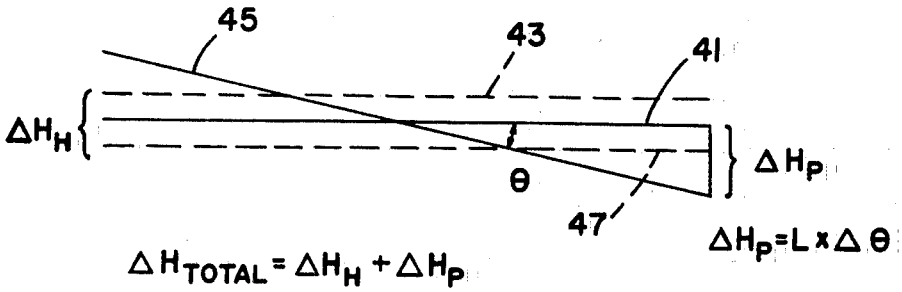
FIG. 5 is a representation of the amount of displacement a structure undergoes due to heave and pitch.

FIGS. 4A–C show a TLP platform 40 in its various response modes. FIG. 4A illustrates the heave response in which the platform 40 is displaced upward to position 42. Heave is also shown in FIG. 5 where the platform 40 displacement may occur upward 43 or downward 47 from the neutral position 41. FIG. 4B illustrates the pitch response where the platform 40 rotates about its transverse axis to position 44. FIG. 5 represents the angular pitch displacement $\theta$ by the tilt of the platform 40 from its neutral position 41 to that of the angled position 45. FIG. 4C shows platform 40 as it is displaced due to both heave and pitch by position 50. It must be remembered that these motions will compress and expand the tendons 6 with each mode and when more than one mode is involved the tendom stress is that much greater.

Figure 2:
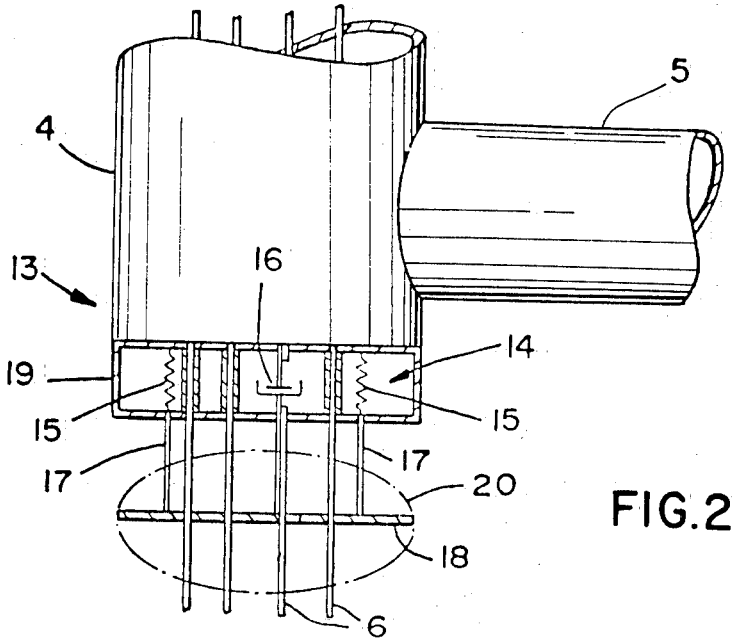
FIG. 2 is an elevation view, partially in section, illustrating the preferred embodiment of the present invention.

FIG. 2 shows a motion damping apparatus 13 which comprises a mechanical energy absorbing portion 14 and a submerged mass or motion damping portion 18. The mechanical energy absorbing portion 14 further comprises springs 15 (linear or non-linear) and/or dampers 16 (such as slowly actuating hydraulic pistons) housed within a vessel 19 at the base of column 4. Vessel 19 should be seawater fluid tight so that corrosion will not occur and also to permit access for maintenance and/or replacement, but this is not absolutely necessary. A connecting bar 17 joins the mechanical energy absorbing portion 14 to the passive damper 18 which, by virtue of its being underneath column 4, is in the water. A mass of seawater 20 is thus trapped by damper 18.

Figure 3:
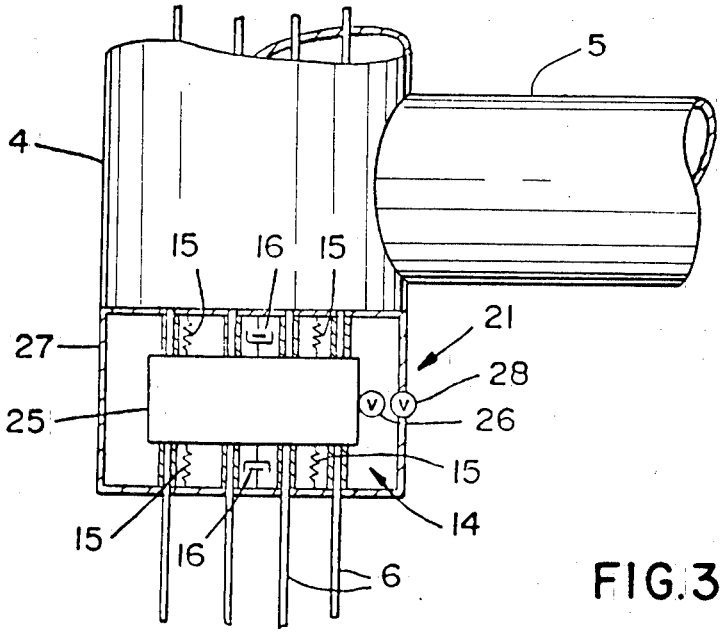
FIG. 3 is an elevation view, partially in section, of an alternate embodiment of the present invention.

FIG. 3 shows another typical embodiment of the invention. Here, the absorbing portion 14 comprises a double set of springs 15 and dampers 16. Another submerged mass 25, which may be solid or an enclosure of liquid, is suspended from springs 15 and dampers 16 and may be either positively or negatively buoyant. One valve 28 is provided for fluid transfer between what may be a fluid-tight vessel 25 and the outside and another valve 26 is provided for fluid transfer between mass 25 and the outside (if mass 25 is used to enclose fluid). These valves 25 and 26 when they are of small diameter will also act as dampers.

Drag force or mere mass provide resistance to movement and are important for the operation of the apparatus in FIG. 2. The motion damper 18 is basically a broad flat plate that will resist movement when it is in water because it traps a mass of liquid 20 (known as added mass) which in turn increases the vibrational period of the damper and also creates a drag force. (This broad flat plate may also have apertures which create additional vortices and provide more drag.) As the structure is excited by secondary wave forces to move either vertically (due to heave) or rotationally (due to pitch), this motion will be resisted by the compensating forces induced by the counter fibrator of the damper. Mass 25 may also operate by a drag principal, but will generally work by mere suspension of its own weight (as will the passive damper 18). Here, the secondary vibrations on the structure are transferred to the mass and its acceptance of the motion damps the motion on the overall structure.

Once these elements are attached to the springs 15 and dampers 16 they may be used to absorb the specific frequency structural motion by adjusting the amount of damping required. It is only necessary to make the natural frequency of the submerged masses 18 and 25 and the absorbing portion 14 equal to the frequency of the TLP. When their frequencies are matched, the structural motion is at all times counteracted by a force of equal amplitude generated by the absorbing apparatus.

For example, if a structure such as a TLP is subjected to the secondary wave force it will be excited at its own natural frequency irrespective of the frequency of the wave. As was stated before, to selectively cut out these smaller oscillations with an absorber, the trick is to make the natural frequency of the absorber and spring equal to the frequency of the vibrating force, i.e., the structure. This may be approximately calculated by the equation, $\omega_n=\sqrt{[K/(M+m)]}$ where $\omega_n$=the response frequency, K=the spring constant, M=the object mass, and m=the hydrodynamic added mass (i.e., the amount of water displaced by the moving structure or apparatus). The response period of both the structure and the motion damping apparatus must be equal so that the resonant energy of the structure may be accepted by the apparatus. To do this, we first calculate the response frequency of the structure using the previous equation (using subscript 1 for the structure's equation and subscript 2 for the apparatus), $\omega_{n1}=\sqrt{[K_1/(M_1+m_1)]}$ where the spring constant of the tendons ($K_1$), the mass of the structure ($M_1$), and the hydrodynamic added mass ($m_1$) are all known and are used to calculate $\omega_{n1}$, the structure's response frequency. Once this is known, it is set equal to the desired response frequency of the motion damping apparatus ($\omega_{n1}=\omega_{n2}$) and the same equation $\omega_{n2}=\sqrt{[K_2/(M_2+m_2)]}$ is used to determine the remaining factors, i.e., the spring constant of the apparatus ($K_1$), the mass of the apparatus ($M_2$), and the hydrodynamic added mass of the apparatus ($m_2$). Once the equation has been solved, the proper spring 15, damper 16, and larger mass (i.e., 18 and 25) may be inserted and "tuned" to the proper frequency to either eliminate the motion on the structure or severely reduce the structure's response. For structures of varying natural period, additional mass or different stiffness springs or dampers may be added.

Since weight is a consideration in TLP design, steps may be taken to reduce the effect the absorber system weight may have on the structure. For example, mass 25 could be a buoyant vessel and still effectively operate by drag forces. Passive damper 18 could have buoyant devices attached to it or could be constructed of a lighter material to reduce the total weight.

Since many modifications and variations of the present invention are possible within the spirit of this disclosure, it is intended that the embodiments disclosed are only illustrative and not restrictive, reference being made to the following claims rather than the specific description to indicate the scope of this invention.

What is claimed is:

1. A motion damping apparatus for substantially dampening structural motion in an offshore structure due to secondary wave excitation, comprising:

an offshore structure; and means for damping motion due to secondary wave excitation, comprising a mechanical energy absorbing means fixedly connected to said offshore structure and a suspended submerged mass fixedly connected to said mechanical energy absorbing means;

said submerged mass and said mechanical energy absorbing means being selected to substantially dampen the structural motion of said structure due to secondary wave excitation.

2. The apparatus as recited in claim 1 further comprising a first means forming a fluid-tight chamber connected to said offshore structure surrounding said mechanical energy absorbing means.

3. The apparatus as recited in claim 1 further comprising a second means for forming a fluid-tight chamber surrounding both said mechanical energy absorbing means and said submerged mass.

4. The apparatus as recited in claim 1 or 3 wherein said submerged mass is a solid weight.

5. The apparatus as recited in claim 1 or 3 where said submerged mass is a flat plate.

6. The apparatus as recited in claim 1 or 3 where said mechanical absorbing means comprises at least one spring.

7. The apparatus as recited in claim 1 or 3 where said mechanical energy absorbing means includes at least one damper.

8. The apparatus as recited in claim 1 or 3 where at least part of said mechanical energy absorbing means is hydraulically actuated.

9. The apparatus as recited in claim 3 where said submerged mass is a second fluid-tight submergible chamber.

10. The apparatus as recited in claim 3 further comprising a first valve means for admitting or expelling fluid from said first fluid-tight submergible chamber.

11. The apparatus as recited in claim 9 further comprising a second valve means for admitting or expelling fluid from said second fluid-tight submergible chamber.

12. An apparatus for damping structural motion due to secondary wave excitation comprising:

an offshore structure;

a first set of a spring and damper combination comprising at least one spring and at least one damper both fixedly connected to said offshore structure;

a first fluid-tight chamber surrounding said first spring and damper combination; and a submerged mass fixedly connected to both said spring and said damper;

said mass, spring, and damper selected to substantially eliminate the structural motion due to secondary wave forces.

13. The apparatus as recited in claim 12 where the submerged mass is a broad flat plate that may trap a large volume of water and create a resistance to movement by drag force.

14. The apparatus as recited in claim 12 further comprising:

means forming a second fluid-tight chamber, said second chamber surrounding said submerged mass;

a second set of a spring and damper combination that is equal in number and kind to said first set, connected between the inside of said fluid-tight chamber and said submerged mass in opposition to said first set.

15. A method for damping the structural motion of an offshore structure due to secondary wave excitation, comprising:

anchoring said offshore structure to the sea floor; and extending a support member from said offshore structure to a motion damper, said motion damper having a mechanical energy absorbing means fixedly connected to said offshore structure and a suspended submerged mass fixedly connected to said mechanical energy absorbing means;

said mechanical energy absorbing means and said suspended submerged mass being selected to substantially dampen the structural motion of said structure due to secondary wave excitation.

16. The method of claim 15 where said mechanical energy absorbing means is enclosed in a first fluid-tight vessel.

17. The method of claim 5 where said submerged mass is a flat plate.

18. The method of claim 15 where said submerged mass is enclosed in a second fluid-tight submergible vessel.

19. The method of claim 15 or 18 where said submerged mass is a third fluid-tight submergible vessel.

20. The method of claim 15 or 18 where said submerged mass is a solid weight.

21. The method of claim 18 where fluid may be selectively admitted or expelled from said first fluid-tight vessel.

22. The method of claim 15 or 18 where the mechanical energy absorging portion has at least one spring between said offshore structure and said submerged mass.

23. The method of claim 15 or 18 where the mechanical energy absorbing portion has at least one damper between said offshore structure and said submerged mass.

24. The method of claim 15 or 18 where the mechanical energy absorber is at least partially hydraulically actuated.

25. A method for reducing secondary wave forces on an offshore structure, comprising the steps of:

measuring the response period of the structure;

measuring the means of the structure;

determining the amount of spring and mass necessary to absorb the secondary structural motion;

fixedly connecting said determined amount of mechanical energy absorbing means to said structure; and fixedly connecting said determined amount of suspended submerged mass to said mechanical energy absorbing means;

so that the secondary wave forces may be substantially eliminated from creating fatique in the structure.

26. The method of claim 25 where the amount of damping spring and submerged mass may be calculated by the equation $\omega_n = \sqrt{[K/(M+m)]}$.

27. The method as recited in claim 20 wherein the response period of the structure is measured by an accelometer.

* * * * *

UNITED STATES PATENT AND TRADEMARK OFFICE

CERTIFICATE OF CORRECTION

PATENT NO. : 4,576,520

DATED : March 18, 1986

INVENTOR(S) : Sung L. Suh et al.

It is certified that error appears in the above-identified patent and that said Letters Patent are hereby corrected as shown below:

Col. 7, Claim 17, line 1, "method of claim 5" should read --method of claim 15--.

Col. 7, Claim 22, line 2, "absorging" should read --absorbing--.

Col. 8, Claim 25, line 4, "measuring the means" should read --measuring the mass--.

Col. 8, Claim 25, line 17, "fatique" should read --fatigue--.

Signed and Sealed this

Twenty-fifth Day of November, 1986

*Attest:*

DONALD J. QUIGG

*Attesting Officer* *Commissioner of Patents and Trademarks*